United States Patent [19]

Klug et al.

[11] Patent Number: 5,024,987

[45] Date of Patent: Jun. 18, 1991

[54] RECORDING MATERIAL

[75] Inventors: Günter Klug, Monheim; Gert Jabs, Odenthal; Horst Berneth, Leverkusen; Artur Botta, Krefeld, all of Fed. Rep. of Germany

[73] Assignee: Bayer Aktiengesellschaft, Leverkusen, Fed. Rep. of Germany

[21] Appl. No.: 438,921

[22] Filed: Nov. 17, 1989

[30] Foreign Application Priority Data

Dec. 7, 1988 [DE] Fed. Rep. of Germany ..... 3841184

[51] Int. Cl.[5] ..... B41M 5/136

[52] U.S. Cl. ..... 503/211; 427/151; 503/212; 503/216; 503/217; 503/218; 503/223

[58] Field of Search ..... 427/150, 151, 152; 503/217, 218, 223, 210–212, 216

[56] References Cited

U.S. PATENT DOCUMENTS 4,403,791 9/1983 Schmidt et al. ..... 427/150

FOREIGN PATENT DOCUMENTS 264501 4/1988 European Pat. Off. ..... 503/218
264751 4/1988 European Pat. Off. ..... 503/218
315901 5/1989 European Pat. Off. ..... 503/223
2362956 7/1974 Fed. Rep. of Germany ..... 503/218
0095977 4/1988 Japan ..... 503/213

*Primary Examiner*—Bruce H. Hess
*Attorney, Agent, or Firm*—Sprung Horn Kramer & Woods

[57] ABSTRACT

Pressure-sensitive reactive recording material containing a) as the color-forming agent, a tetraindolylheptamethine ether or alcohol of the formulae I/1, I/2, I/3 or I/4

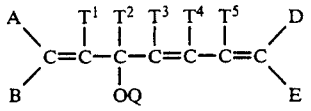

I/1

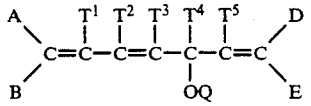

I/2

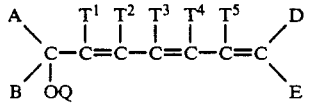

I/3

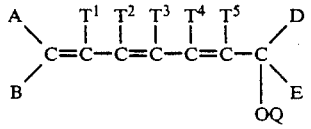

I/4 b) and, as the color developer, the salt of a polyvalent metal and an aromatic carboxylic acid having at least 10 carbon atoms, of the formula (II)

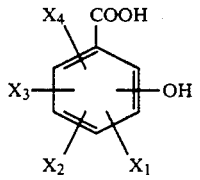

(II)

wherein A, B, D and E denote

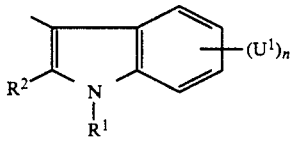

and the other radicals have the meanings given in the description, produces light-stable copies which can also be read by machines (OCR).

20 Claims, No Drawings

RECORDING MATERIAL

The present invention relates to machine-readable pressure-sensitive reactive recording material.

By this there are understood, in particular, papers on which visible representations can be produced by image-wise mechanical pressure. These include the known reactive carbon copy papers (compare M. Gutcho, Capsule Technology and Microencapsulation, Noyes Data Corporation, 1972, pages 242–277; G. Baxter in Microencapsulation, Processes and Applications, published by J.E. Vandegaer, Plenum Press New York, London, pages 127 –143).

Reactive carbon copy papers consist, for example, of two or more sheets of paper loosely laid on top of one another, the particular upper sheet containing a donor layer on the reverse side and the particular lower sheet containing a receiver layer on the front side. A donor layer and a receiver layer are thus in each case in contact with one another. The donor layer contains, for example, microcapsules, the core material of which is a solution of a dyestuff-forming agent in an organic solvent, that is to say a material which converts the dyestuff-forming agent into the dyestuff. A carbon copy is formed if the microcapsules are destroyed by the pressure of a writing instrument, and the dyestuff-forming agent reacts image-wise with the colour developer. The dyestuff-forming agent and colour developer can also be applied to the same sheet of paper. This is then referred to as "self-contained paper". Writing can be produced on such material by image-wise pressure.

Such processes and formulations are known, for example, from U.S. Pat. Nos. 2,800,457, 2,800,458, 2,948,753, 3,096,189 and 3,193,404 and from German Offenlegungsschriften (German Published Specifications) 2,555,080 and 2,700,937.

Recording materials which absorb in the near infra-red are required in order to be able to read the recorded information using suitable apparatuses. The spread of computers and automatic data processing require apparatuses which can read information from documents. Equipment for optical character recognition (OCR) which can read pages of text written in the particular programmed typeface has therefore been developed. Such equipment usually operates in the near infra-red and the writing to be read must therefore of course have absorptions in the near infra-red. However, the usual pressure-and heat-sensitive recording materials do not have such an absorption in the near infra-red.

Recording materials which have such an absorption in the near infra-red are described, for example, in U.S. Pat. Nos. 4,020,056, 4,022,771, 4,026,883, 4,107,428 and 4,119,776 and in European Application 0,124,377.

It is furthermore known that the dyestuff-forming agents which are contained in the recording materials described and are developed under acid conditions, such as, for example, crystal violet lactone and 3-diethylamino-6-methyl-7-anilino-fluorane, have only a relatively low light stability (N. Kuramoto and T. Kitao; Dyes and Pigments, 3, 49–58 (1982)).

Surprisingly, it has now been found that the use of specific tetraindolyl-heptamethines as dyestuff-forming agents in combination with metal salicylates as developers give higher intensities and better light stabilities of the copies in the IR range in reactive carbon copy papers than when other developer systems are used. This combination is therefore particularly suitable for producing copies which are to be read by machine (OCR).

The invention thus relates to a recording material containing colour-forming agents and colour developers as characteristic constituents, characterized in that a) the dyestuff-forming agent is a tetraindolylheptamethine ether or alcohol of the formulae I/1, I/2, I/3 or I/4

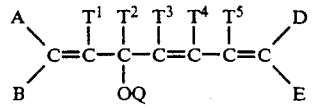
I/1

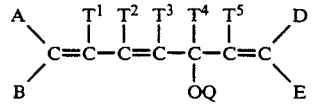
I/2

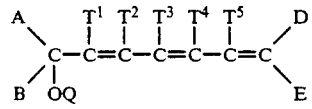
I/3

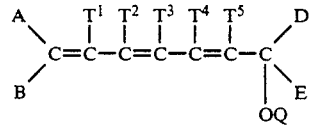
I/4 b) and the colour developer is the salt of a polyvalent metal and an aromatic carboxylic acid having at least 10 carbon atoms, of the formula (II)

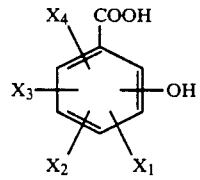
(II)

wherein, in the abovementioned formulae, A, B, D and E denote

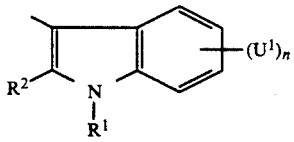

and can be identical to or different from one another,

Q denotes hydrogen, alkyl, alkenyl, cycloalkyl, aralkyl, aryl or a heterocyclic radical which is bonded via alkyl, $R^1$ denotes hydrogen, alkyl, alkenyl, cycloalkyl, aralkyl or a heterocyclic radical which is bonded via alkyl, $R^2$ denotes hydrogen, alkyl, alkenyl, cycloalkyl, aralkyl aryl or a heterocyclic radical which is optionally bonded via alkyl, $T^1$ to $T^5$ denote hydrogen, alkyl, alkenyl, cycloalkyl, aralkyl, halogen, alkoxy, dialkylamino, cyano, hydroxycarbonyl, alkoxycarbonyl, aryl or a heterocyclic radical which is optionally bonded via alkyl, or in each case two of the radicals $T^1$ to $T^5$ denote the missing members of a 5- to 7-membered ring, which can be aromatic or partly hydrogenated and can contain up to 2 heteroatoms from the series comprising O, N or S, $U^1$ denotes hydrogen, alkyl, alkenyl, cycloalkyl, aralkyl, aryl, hydroxyl, alkoxy, halogen, dialkylamino, nitro, cyano, alkylthio, alkoxycarbonyl, dialkylaminocarbonyl, alkoxycarbonyloxy or alkylsulphonyl, or, together with $R^1$, denote a $C_2$- or $C_3$-bridge, n denotes 1 or 2, $X_1$, $X_2$, $X_3$ and $X_4$ denote hydrogen, halogen, hydroxyl, alkyl, cycloalkyl, aryl, alkaryl, aralkyl, alkoxy or aryloxy, or two adjacent radicals $X_1$, $X_2$, $X_3$ and $X_4$ together can form a ring, and wherein all the cyclic and non-cyclic radicals can carry nonionic substituents which are customary in dyestuff chemistry.

The hydrocarbon radicals mentioned in any desired connection above have the preferred meanings given below.

Alkyl radicals, including those in, for example, alkoxy, alkylamino or aralkyl, can contain up to 18 C atoms and can be substituted, for example, by halogen, alkoxy, nitro, cyano, alkoxycarbonyl or alkylsulphonyl.

Alkenyl radicals can contain up to 18 C atoms and can be substituted, for example, by halogen, alkoxy, cyano or alkoxycarbonyl.

Cycloalkyl radicals can contain 3 to 8 C atoms and can be substituted, for example, by alkyl, alkoxy, halogen, cyano, alkoxycarbonyl or aryl.

Aryl radicals, including those in aralkyl and alkaryl groups, are phenyl, naphthyl or anthracenyl, which can be substituted, for example, by alkyl, alkoxy, halogen, cyano, alkoxycarbonyl, nitro, aryl or heterocyclic radicals, up to 5 substituents, which do not have to be identical, being possible.

Heterocyclic radicals, including those which are bonded via alkyl, are 5- to 7-membered aromatic or quasi-aromatic heterocyclic radicals or their partly or completely hydrogenated derivatives which contain 0, N, S or $SO_2$ as heteroatoms, a maximum of 4 such heteroatoms, which can be a mixture with one another, occurring in one ring and it being possible for these heterocyclic radicals to be fused by benzene, naphthalene or pyridine and/or substituted by alkyl, alkoxy, halogen, cyano, alkoxycarbonyl, nitro or aryl.

Suitable metal salts of the carboxylic acids II are those from the group comprising: zinc, aluminium, calcium, magnesium, titanium, nickel, cobalt, manganese, iron, tin, chromium, copper and vanadium The colour developers can additionally be employed as a mixture with pigments which are unreactive per se or of lower reactivity or other auxiliaries, such as silica gel. Examples of such pigments are: talc, titanium dioxide, zinc oxide and chalk; clays, such as kaolin, and organic pigments, for example urea-formaldehyde or melamine-formaldehyde condensation products.

The colour developers can also be blended with other developers, such as, for example, attapulgite clay, acid clay, bentonite or montmorillonite; halloysite, zeolite, silicon dioxide, aluminium oxide, aluminium sulphate, aluminium phosphate, zinc chloride or kaolin, and other clays or acid-reacting organic compounds, such as, for example, ring-substituted phenols, acid-reacting polymeric materials, such as phenolic polymers, alkylphenolacetylene resins, maleic acid-colophony resin, or partly or completely hydrolyzed polymers of maleic anhydride and styrene, ethylene or vinylmethyl esters or polyacetals.

Suitable capsule wall materials for enclosing the dyestuff-forming agents are, for example, gelatin/gum arabic, polyamides, polyurethanes, polyureas, polysulphonamides, polyesters, polycarbonates, polysulphonates, polyacrylates and phenol-, melamine- or urea-formaldehyde condensates, such as are described, for example, in M. Gutcho, Capsule Technology and Microencapsulation, Noyes Data Corporation 1972; G. Baxter, Microencapsulation, Processes and Applications, publisher J.E. Vandegaer; and German Offenlegungsschriften (German Published Specifications) 2,237,545 and 2,229,933.

Preferred dyestuff-forming agents are tetraindolyheptamethine ethers or alcohols of the isomeric formulae

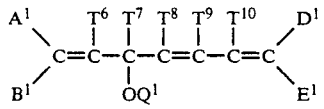
III

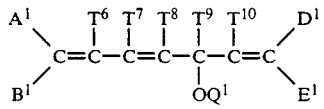
IV

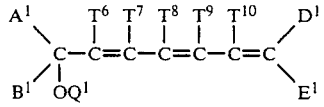
V and

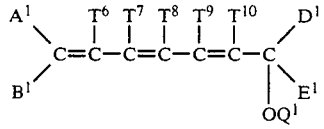
VI wherein $A^1$, $B^1$, $D^1$ and $E^1$ denote

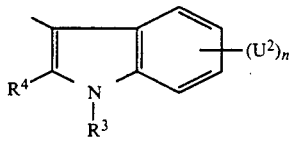

and can be identical to or different from one another, $Q^1$ denotes hydrogen, $C_1$- to $C_{18}$-alkyl, which can be substituted by chlorine, $C_1$- to $C_4$-alkoxy, cyano or $C_1$- to $C_4$-alkoxycarbonyl, allyl, cyclopentyl, cyclohexyl or benzyl, phenethyl, naphthylmethyl, picolyl, phenyl or naphthyl radicals which are optionally substituted by $C_1$- to $C_4$-alkyl, chlorine and/or $C_1$- to $C_4$-alkoxy, $R^3$ denotes hydrogen, $C_1$- to $C_{18}$-alkyl, which can be substituted by chlorine, $C_1$- to $C_4$-alkoxy, cyano or $C_1$ to $C_4$-alkoxycarbonyl, allyl, cyclopentyl, cyclohexyl or benzyl, phenethyl, naphthylmethyl or picolyl radicals which are optionally substituted by $C_1$- to $C_4$-alkyl, chlorine and/or $C_1$- to $C_4$-alkoxy, denotes hydrogen, $C_1$- to $C_{18}$-alkyl, which can be substituted by chlorine, $C_1$- to $C_4$-alkoxy, cyano or $C_1$- to $C_4$-alkoxycarbonyl, allyl, cyclopentyl, cyclo-hexyl or benzyl, phenethyl, naphthylmethyl, picolyl, quinolylmethyl, phenyl, naphthyl, pyridyl, pyrimidyl, pyrazinyl, imidazolyl, oxazolyl, thiazolyl, triazolyl, benzimidazolyl, benzoxazolyl, benzothiazolyl or quinolyl radicals which are optionally substituted by $C_1$- to $C_4$-alkyl, chlorine, bromine, $C_1$- to $C_4$-alkoxy, cyano, nitro and/or $C_1$- to $C_4$-alkoxycarbonyl, $T^6$ to $T^{10}$ denote hydrogen, $C_1$- to $C_8$-alkyl, which can be substituted by chlorine, $C_1$- to $C_4$-alkoxy, cyano or $C_1$- to $C_4$-alkoxycarbonyl, vinyl, allyl, cyclohexyl, cyclopentyl, fluorine, chlorine, bromine, $C_1$- to $C_8$-alkoxy, which can also be substituted by $C_1$- to $C_8$-alkoxy, $C_1$- to $C_4$-dialkylamino, piperidino, pyrrolidino, nitro, cyano, $C_1$- to $C_4$-alkoxycarbonyl or benzyl, phenethyl, naphthylmethyl, picolyl, phenyl, naphthyl, pyridyl, quinolyl, pyrimidyl, pyrazinyl, indolyl, indolenyl, indolizinyl, imidazolyl, oxazolyl, thiazolyl, triazolyl, benzimidazolyl, benzoxazolyl or benzothiazolyl radicals which are optionally substituted by $C_1$- to $C_4$-alkyl, chlorine, $C_1$- to $C_4$-alkoxy, $C_1$- to $C_4$-alkylsulphonyl, cyano and/or $C_1$- to $C_4$-alkoxycarbonyl, or in each case two of the radicals $T^6$ to $T^{10}$ denote a bridge of the formulae $-CH_2CH_2-$, $-CH_2CH_2CH_2-$, $-CH_2CH_2CH_2CH_2-$, $-CH_2SCH_2-$, $-CH_2-\underset{H_3C}{\underset{/}{C}}\underset{CH_3}{\underset{\backslash}{}}-CH_2-$, $-O-\underset{H_3C}{\underset{/}{C}}\underset{CH_3}{\underset{\backslash}{}}-O-$, $-CH=CH-CH_2-$, $-CH=CH-CH=CH-$,

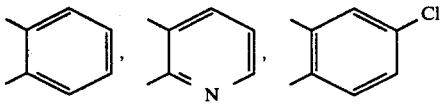

$U^2$ denotes hydrogen, $C_1$- to $C_8$-alkyl, allyl, cyclohexyl, benzyl, phenyl, hydroxyl, $C_1$- to $C_4$-alkoxy, chlorine, bromine, $C_1$- to $C_4$-dialkylamino, nitro, cyano, $C_1$- to $C_4$-alkylthio, $C_1$- to $C_4$-alkoxycarbonyl, $C_1$- to $C_4$-dialkylaminocarbonyl, $C_1$- to $C_4$-alkoxycarbonyloxy or $C_1$- to $C_4$-alkylsulphonyl, or, together with $R^3$, denotes a $-CH_2CH_2-$ or $-CH_2CH_2CH_2-$bridge, which can be substituted by a maximum of 3 methyl groups, and denotes 1 or 2.

Particularly preferred tetraindolylheptamethine ethers or alcohols are those of the formulae V to VIII wherein $Q^1$ denotes hydrogen, $C_1$- to $C_8$-alkyl, which can be substituted by chlorine, methoxy, ethoxy or cyano, allyl, cyclopentyl, cyclohexyl or benzyl, phenethyl or picolyl radicals which are optionally substituted by methyl, chlorine or methoxy, $R^3$ denotes hydrogen, $C_1$- to $C_8$-alkyl, which can be substituted by chlorine, methoxy, ethoxy, cyano or methoxycarbonyl, allyl, cyclopentyl, cyclohexyl or benzyl, phenethyl or picolyl radicals which are optionally substituted by methyl, chlorine or methoxy, $R^4$ denotes hydrogen, $C_1$- to $C_8$-alkyl, which can be substituted by chlorine, methoxy, ethoxy, cyano or methoxycarbonyl, allyl, cyclopentyl, cyclohexyl or benzyl, phenethyl, picolyl, phenyl, naphthyl, pyridyl, pyrimidyl, benzimidazolyl, benzoxazolyl, benzothiazolyl or quinolyl radicals which are optionally substituted by methyl, chlorine, methoxy, cyano, nitro and/or methoxycarbonyl, $T^6$ and $T^{10}$ denote hydrogen, $C_1$- to $C_8$-alkyl, which can be substituted by chlorine, methoxy, cyano or methoxycarbonyl, vinyl, allyl, cyclopentyl, cyclohexyl, chlorine, $C_1$- to $C_8$-alkoxy, cyano, methoxycarbonyl, nitro, benzyl or phenyl or pyridyl radicals which are optionally substituted by methyl, chlorine, cyano or methoxy, $T^7$ to $T^9$ denote hydrogen, $C_1$ - to $C_8$- alkyl, which can be substituted by chlorine, methoxy, cyano or methoxycarbonyl, allyl, cyclopentyl, cyclohexyl, chlorine, bromine, cyano, methoxy- and ethoxycarbonyl, nitro, $C_1$- to $C_4$-alkoxy, $C_1$- to $C_4$-dialkylamino, benzyl or phenyl, naphthyl, pyridyl, quinolyl, pyrimidyl, indolenyl, indolizinyl, imidazolyl, oxazolyl, thiazolyl, benzimidazolyl, benzoxazolyl or benzothiazolyl radicals which are optionally substituted by methyl, ethyl, chlorine, methoxy, ethoxy, cyano, nitro and/or methoxycarbonyl, or $T^7$ with $T^8$ or $T^9$ or $T^8$ with $T^9$ denote a bridge of the formulae $-CH_2CH_2-$, $-CH_2CH_2CH_2-$, $-CH_2-\underset{H_3C}{\underset{/}{C}}\underset{CH_3}{\underset{\backslash}{}}-CH_2-$, $-CH=CH-CH_2-$, $-CH=CH-CH=CH-$ or

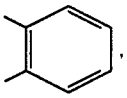

$U^2$ denotes hydrogen, $C_1$- to $C_4$-alkyl, cyclohexyl, benzyl, $C_1$- to $C_4$-alkoxy, chlorine, $C_1$- to $C_4$-dialkylamino, nitro, cyano, methoxy- or ethoxycarbonyl or methylsulphonyl, it being possible for $U^2$ to be in the 5-, 6- and/or 7-position on the indolyl radical or for a radical $U^2$ in the 7-position to form, together with $R_3$, a bridge of the formulae $-CH_2CH_2-$ $-CH_2\underset{CH_3}{\underset{|}{CH}}-$, $-\underset{CH_3}{\underset{|}{CH}}-\underset{CH_3}{\underset{|}{CH}}-$, $-\underset{H_3C}{\underset{/}{C}}\underset{CH_3}{\underset{\backslash}{}}-\underset{CH_3}{\underset{|}{CH}}-$, $-CH_2CH_2CH_2-$, $-CH_2CH_2\underset{CH_3}{\underset{|}{CH}}-$, $-\underset{H_3C}{\underset{/}{C}}\underset{CH_3}{\underset{\backslash}{}}-CH_2-\underset{CH_3}{\underset{|}{CH}}-$ and n denotes 1 or 2.

Especially preferred tetraindolylheptamethine ethers or alcohols are those of the formula

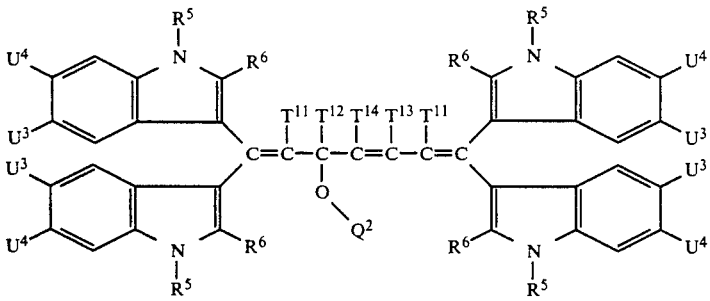

(VII)

and their isomeric forms in respect of the position of the $Q^2O$ group, such as are shown in the formulae II to IV and VI to VIII, wherein $Q^2$ denotes hydrogen, methyl, ethyl, propyl, butyl, hexyl, octyl, cyclohexyl or benzyl, $R^5$ denotes methyl, ethyl, propyl, butyl, hexyl, octyl, 2-cyanoethyl, 2-methoxyethyl, 2-methoxycarbonylethyl, 2-chloroethyl, 2-acetoxyethyl, cyclohexyl, allyl or benzyl, $R^6$ denotes methyl, ethyl, propyl, butyl, hexyl, octyl, cyclohexyl, benzyl, phenyl, 2-, 3- or 4-chlorophenyl, 2-, 3- or 4-methoxy-phenyl, 4-nitro-phenyl, 2,4-dichloro-phenyl, 2-, 3- or 4-tolyl or 2-, 3- or 4-pyridyl, $T^{11}$ and $T^{13}$ denotes hydrogen, methyl, ethyl, propyl, butyl, vinyl, 2-chloro-ethyl, 2-cyano-ethyl, chloro, cyano, phenyl, 4-tolyl or 4-chloro-phenyl, $T^{12}$ and $T^{13}$ denote hydrogen, methyl, ethyl, propyl, butyl, chloro, cyano, methoxycarbonyl, dimethylamino, phenyl, 4-tolyl, 4-chloro-phenyl or pyridyl or $T^{12}$ and $T^{13}$ together denote a grouping of the formulae

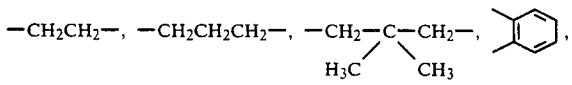

$T^{14}$ denotes hydrogen, methyl, ethyl, propyl, butyl, chloro, bromo, cyano, phenyl, 4-tolyl, 4-chlorophenyl, 4-nitro-phenyl, 4-pyridyl, 3,3-dimethyl-indolen-2-yl, indolizin-2-yl, 2-benzimidazolyl, 2-benzooxazolyl or 2-benzothiazolyl and $U^3$ and $U^4$ denote hydrogen, methyl, methoxy, chloro, cyano, methoxycarbonyl or nitro.

Preferred colour developers are those of the formula II, wherein at least one of the radicals $X^1$–$X^2$ represents aralkyl and the other radicals represent H.

Particularly preferred colour developers are compounds of the formula VIII

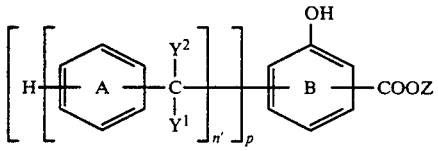

VIII wherein the rings A and B can contain further substituents and wherein $Y^2$ denotes H or $CHY^3Y^4$ and $Y^1$, $Y^3$ and $Y^4$ independently of one another denote H or alkyl (in particular having 1 to 4 C atoms) or, together with at least 2 C atoms of the ring A, denote the radical to complete a ring, in particular a carbocyclic ring, Z denotes M+/M M denotes an m-valent metal ion, in particular $Cu^{2+}$, $Zn^{2+}$, $Fe^{2+}$, $Fe^{3+}$, $Al^{3+}$, $Mg^{2+}$or $Ca^{2+}$, m denotes an integer, in particular 2 or 3, $n^1$ denotes an integer, at least 1, in particular 2 to 30 and specifically 3 to 6, and p denotes an integer from 1 to 4.

In a particularly preferred embodiment, the compounds of the abovementioned formula VIII correspond to the following structure

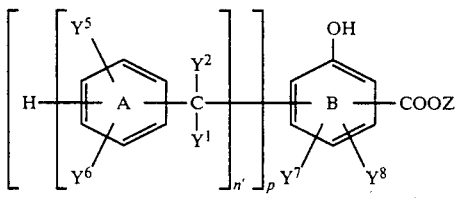

IX wherein $Y^1$to $Y^4$, Z, M, m, $n^1$ and p have the abovementioned meaning, and wherein, $Y^5$ to $Y^8$ independently of one another denote hydrogen, alkyl, in particular having 1 to 18 C atoms, aralkyl, in particular benzylor α-methylbenzyl, halogen, in particular chlorine, alkoxy, in particular having 1 to 24 C atoms, COOH, $COOY^9$, CN, $NO_2$ or -O-CO-$Y^{12}$ or cycloalkyl, wherein $Y^7$ and $Y^8$ independently of one another can also denote

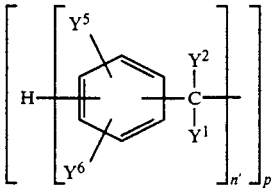

wherein $Y^9$ alkyl, in particular 1 to 24 C atoms, aryl, in particular phenyl, or $NY^{11}Y^{10}$, $Y^{10}$ and $Y^{11}$ independently of one another hydrogen or alkyl, in particular having 1 to 24 C atoms and $Y^{12}$ alkyl, in particular $C_1$–$C_{18}$, and wherein the group COOZ in ring B is preferably in the o-position relative to the OH group.

Such compounds and the preparation of corresponding suspensions are known, for example, from DE-OS (German Published Specification) 3,635,311 and 3,635,742. The Al, Mg, Ca and in particular Zn salts are preferred.

The colour development properties of the colour developers according to the invention are particularly favourable when they are employed as "hybrid systems", that is to say when they are combined, for example, with chemically modified aluminium silicates in larger form based on montmorillonite. The coating compositions must furthermore be provided with binders in order to fix the colour developers onto a carrier. Since paper is preferably suitable as the carrier, these binders are chiefly paper-coating agents, such as gum arabic, polyvinyl alcohol, hydroxymeth-ylcellulose, casein, methylcellulose, dextrin, starch, starch derivatives or polymer latices. The latter are, for example, but adiene-styrene copolymers or acrylic mono- or copolymers.

The coating compositions containing the colour donors according to the invention allow the use of various known coating techniques, for example application with a blade coater and other customary coating techniques. However, in addition to aqueous coating compositions, incorporation into printing inks for flexographic or offset printing is also possible. The coating compositions containing the colour developers according to the invention allow the use of various known coating techniques, for example application with a blade coater or other customary coating techniques.

For preparation of an offset or letterpress printing ink, the developer resins according to the invention can be ground with a suitable varnish on a triple roll mill. The preparation of such offset printing inks is known prior art.

Coated-back papers coated with capsules containing the dyestuff-forming agents according to the invention dissolved in an organic solvent are brought into contact in the customary manner with coated-front papers coated with the developer substances according to the invention; or capsules containing the dyestuff-forming agents according to the invention dissolved in an organic solvent are applied in the customary manner, together with the colour developers according to the invention, to the upper side of a sheet, which is used in the customary manner as "self-contained paper" in a carbon copy set. The copy is now formed by imagewise mechanical pressure on the surface of the coated-back paper by development of the dyestuff-forming agent solution discharged from the destroyed capsules on the surface of the coated-front paper.

To measure the reflectance, for example, an impression (copy) of large area is produced on the front side of a coated-front paper containing the colour developer according to the invention by, for example, pressure-induced destruction of the capsules containing the colour-forming agent according to the invention on the reverse side of a corresponding coated-back paper, or an impression of large area is made on the front side of a base paper by, for example, pressure-induced destruction of the capsules, containing the colour-forming agent according to the invention, mixed with the colour developers according to the invention.

The intensity of this copy in the IR range can be determined using the usual optical spectrophotometers, such as, for example, a Xenocolor LS 100 from Lange or an El Repho 44381 from Carl Zeiss, by measuring the reflectance at a certain wavelength in the IR range and then calculating the absorption at this wavelength by $$\% \, Abs_{\lambda} = \frac{\% \text{ Ref. } CF_{\lambda} - \% \text{ Ref. copy}_{\lambda}}{\% \text{ Ref } CF_{\lambda}} \cdot 100$$

wherein $\%ABS_{80}$ is the absorption at the wavelength$_{80}$

% Ref $CF_{\lambda}$, is the reflectance of the coated front at the wavelength $_{80}$ (blank value)

$\%Ref.copy_{80}$ is the reflectance of the copy at the wavelength$_{80}$

The intensity of an exposed copy is measured in an analogous manner.

For this, the copy of which the intensity has been determined at a certain wavelength is first of all irradiated for 48 hours in a box using light emitted by four 18 watt fluorescent tubes (Sylvania-Luxline-ES; daylight de luxe).

The intensities of the copy and the exposed copy are determined in the IR range between 700 and 1200 m, preferably between 800 and 1000 nm and particularly preferably between 840 and 910 nm.

The use of the colour-forming agents according to the invention present in microcapsules in combination with the colour developers according to the invention shows significantly higher intensities and a lower loss of intensity before and after exposure than the use of the colour-forming agents according to the invention on other colour developers, such as, for example, clay and phenolic resins.

EXAMPLE 1

21.9 g of 1,1-bis-(1-methyl-2-phenyl-indol-2-yl)ethene and 4.3 g of 1,1,3,3-tetramethoxypropane are stirred at 80° C. in a mixture of 50 ml of acetic anhydride and 2.5 g of methanesulphonic acid for 1 hour. The black-blue solution, which contains the dyestuff of the formula

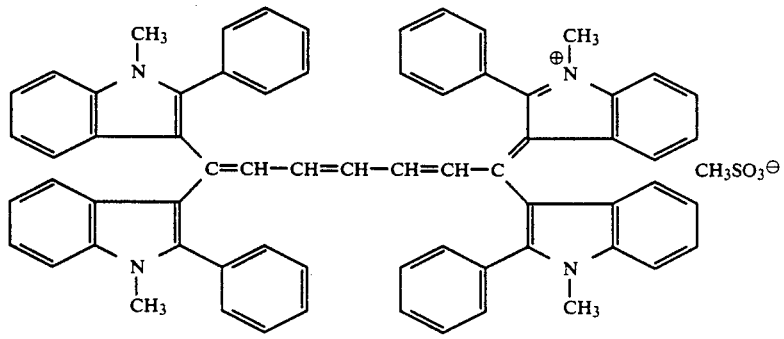

is discharged onto 200 ml of methanol and rendered alkaline with 50 ml of 30 % strength methanolic sodium methylate solution. The beige-brown product is filtered off with suction, washed with methanol and water and dried:

22.0 g (94.6 % of theory). The product is boiled in 200 ml of methanol for 2 hours, the mixture is cooled and the product is filtered off with suction and dried:

18.5 g (79.6 %) of brownish-beige powder of melting point 216–218° C.

In an isomeric form, the product corresponds to the formula:

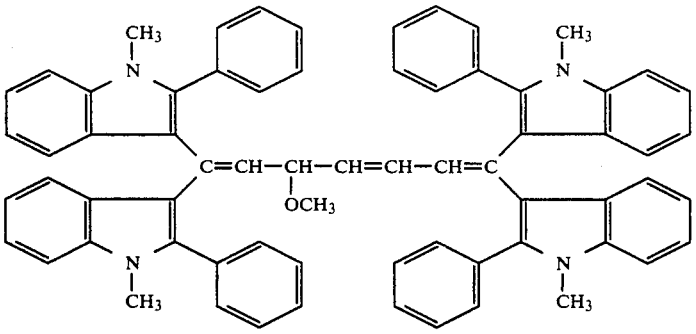

A solution in glacial acetic acid has a dirty blue colour and a $\lambda_{max}$ of 863 nm. A solution in toluene develops a pale grey-blue colouration on acid clay. An absorption of 750 to 950 mm can be measured in the infrared.

EXAMPLE 2

21.9 g of 1,1-bis-(1-methyl-2-phenyl-indol-3-yl)ethene and sodium 2-(benzothiazol-2-yl)-3-oxo-prop-1-en-1-olate) are stirred at 90° C. in a mixture of 50 ml of acetic anhydride and 7.7 g of trifluoromethanesulphonic acid for 1 hour. After cooling, the greenish-blue solution, which contains the dyestuff of the formula

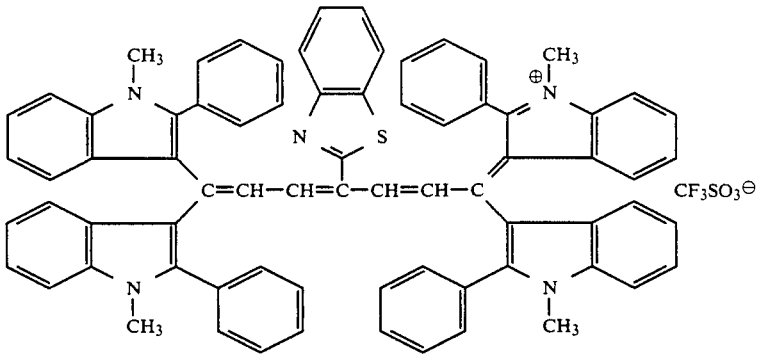

is discharged into 250 ml of methanol and rendered alkaline with methanolic methoxide solution. The solid is filtered off with suction and washed with methanol and water. Recrystallization from butanol gives 22.3 g (82.8 %) of a yellow powder of melting point 217° to 219° C. In an isomeric form, the product corresponds to the formula

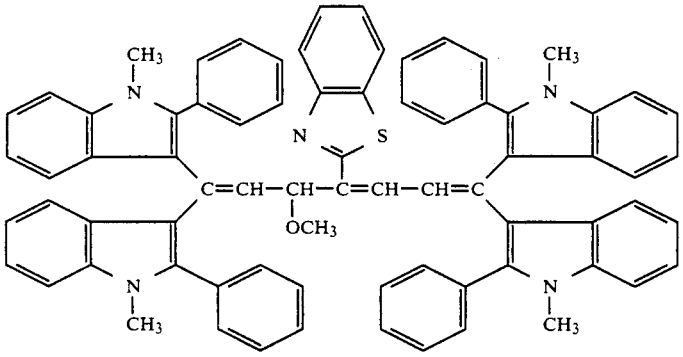

$\lambda_{max}$ in glacial acetic acid; 859 nm

On acid clay: greenish-grey, 750 to 950 nm.

EXAMPLE 3

1038 g (7.5 mol) of salicyclic acid, 1012.8 g (8 mol) of benzyl chloride, 63.2 g (0.5 mol) of $ZnCl_2$ and 50 ml of $H_2O$ are melted in an oil bath, while stirring and passing through nitrogen, vigorous elimination of HCl starting at 120° C. A further 2785.2 g (22 mol) of benzyl chloride are run in at 120 to 130° C. in the course of 3 hours and the mixture is subsequently stirred at the same temperature for a further 5 hours until the evolution of HCl has ended, while passing nitrogen through the melt. Subsequent stripping off of volatile components in vacuo gives only small amounts (about 10 g) of distillate. The yield is 3789 g (99.9 % of theory) of a pale yellowish-brownish brittle resin.

1990 g of a 10 % strength aqueous solution of a partly hydrolyzed polyvinyl acetate and 135 g (about 1.5 mol) of 45 % strength sodium hydroxide solution are run into the resin, while cooling the melt at about 100° C. and with thorough stirring using an anchor-type stirrer, and the mixture is subsequently stirred at 60°-70° C. for a further 30 minutes until a stable colourless dispersion has formed. A smooth slurry of 265 g (3.25 mol) of ZnO in 1780 g of $H_2O$ is gradually stirred into this dispersion at a rate such that a temperature of about 40°-45° C. is established. The mixture is stirred thoroughly at this temperature for about a further hour until the Zn complex has formed completely. To remove any specks, the mixture is milled on a triple roll mill to give 7955 g of an almost colourless viscous but pourable dispersion.

EXAMPLE 4

Styrene is employed instead of benzyl chloride analogously to the procedure in Example 3, α-methylbenzylated salicylates corresponding to DE-A 3,635,742 being formed.

EXAMPLE 5

26 g of 3,5-bis-(6-isocyanato-hexyl)-2H-1,3,5-oxadiazine-2,4,6-(3H, 5H)-trione were stirred into 174 g of a colour donor mixture containing to the extent of 3 % the dyestuff-forming agent from Example 1 in an isomer mixture of diisopropylnaphthalene. This mixture obtained was emulsified with 251 g of a 0.5 % strength polyvinyl acetate solution (Mowiol 26/88; Hoechst AG) on a rotorstator dispersing apparatus so that the average droplet size of the emulsion was 7 μm. 49 g of a 9 % strength diethylenetriamine solution were now added, while stirring, and the mixture was conditioned at 60° C. for 2 hours. A microcapsule dispersion, the dry content determination of which showed a weight content of 39.9 %, was thus obtained.

EXAMPLE 6

80 g of a 3 % strength colour-forming agent solution of the colour-forming agent from Example 2 in an isomer mixture of diisopropylnaphthalene were microencapsulated by the coacervation process as described in German Patent Specification DE 3,008,390 in Example II. The average capsule size was 5.5 μm and the weight content of the capsules after determination of the dry weight was 45.1 %.

EXAMPLE 7

(Production of a coated-back paper)

2.1 g of Arbocell® BE 600/30 (comminuted cellulose fibres), 2.0 g of Baystal® P 1700 (latex based on a styrene/butadiene copolymer) and 16.3 g of water were stirred into 12.9 g of a 40 % strength capsule dispersion. This mixture was applied to a base paper (40 g/m²) by means of a 40 μm doctor blade and dried. A coated-back paper with a coating weight of about 5.5 g/m² was thus obtained.

EXAMPLE 8

(Production of a coated-front paper)

312 g of water were brought to pH 11 with concentrated sodium hydroxide solution. 91.7 g of china clay and 20 g of 5 % strength carboxymethylcellulose solution were stirred into this mixture. 50 g of developer dispersion according to Example 3 and 16 g of Baystal P 1700 binder were now added in succession and the pH was brought to 9. This mixture was applied to a base paper (40 g/m²) by means of a 40 μm doctor blade and dried, and a coated-front paper with a coating weight of about 5 g/m² was thus obtained.

EXAMPLE 9-13

The coated-back papers produced in Example 7 were combined in the customary manner with the coated-front papers produced in Example 8 and commercially available coated-front papers coated with various developer substances. The copy is formed by impression of a roller of width 39 mm under a constant force of 680 N over a zone of about 20 cm.

The reflectance spectra of the copies from 400 to 1200 mm are now recorded with a Xenocolor LS 100 from Dr. Lange, the particular absorption being obtained from $$\% Abs_\lambda = \frac{\% \text{ Ref. } CF_\lambda = \% \text{ Ref. copy}_\lambda}{\% \text{ Ref. } CF_\lambda} \cdot 100$$

$\%Abs_{80}$ absorption of wavelength$_\lambda$ $\%Ref.\ Cf_\lambda$reflectance of the coated-front at the wavelength$_\lambda$(blank value)

% Ref. copy$_\lambda$reflectance of the copy at wavelength$_\lambda$

The absorption values of the copies on various coated-front papers are shown in Table 1.

The absorption maximum, either at 850 mm or 900 mm, here determines the absorption value shown in Table 1. The copy is now exposed to 4 fluorescent tubes (Sylvania-Luxline-ES; 4×18 W) in an exposure box and the absorption value is then determined as described above.

TABLE 1

Absorption values in % of the copies before/after exposure for 24 hours

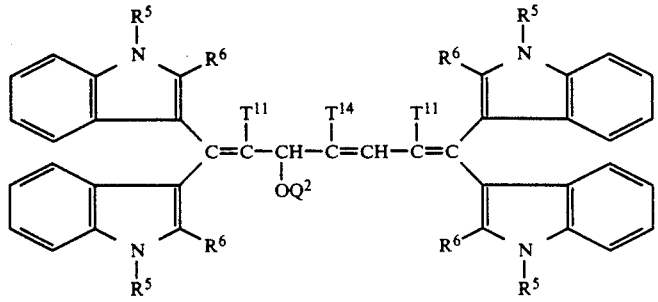

TABLE 1-continued

| Ex. | $R^5$ | $R^6$ | $Q^2$ | $T^{11}$ | $T^{14}$ | Clay coated-front b.e. | Clay coated-front a.e. | Clay coated-front Δ | Phenolic resin coated-front b.e. | Phenolic resin coated-front a.e. | Phenolic resin coated-front Δ | Salicylate resin coated-front (according to Example 3) b.e. | Salicylate resin coated-front (according to Example 3) a.e. | Salicylate resin coated-front (according to Example 3) Δ |
|---|---|---|---|---|---|---|---|---|---|---|---|---|---|---|
| 9* | $CH_3$ | Ph | $CH_3$ | H | H | 56.1 | 16.6 | 29.6 | 57.8 | 45.7 | 79.1 | 72.6 | 61.0 | 84.0 |
| 10* | $C_4H_9$ | Ph | $CH_3$ | H | H | 70.9 | 11.9 | 16.5 | 56.9 | 46.0 | 80.8 | 75.8 | 66.9 | 88.3 |
| 11* | $C_2H_5$ | Ph | $CH_3$ | H | H | 73.3 | 23.1 | 31.5 | 71.8 | 56.5 | 78.6 | 81.5 | 66.1 | 81.1 |
| 12** | $CH_3$ | Ph | $CH_3$ | H | 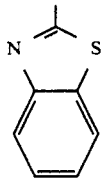 | 66.9 | 16.2 | 24.2 | 69.9 | 61.3 | 87.7 | 75.9 | 69.6 | 91.7 |
| 13* | $CH_3$ | Ph | $CH_3$ | H | 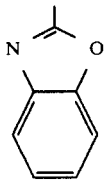 | 49.2 | 21.0 | 42.7 | 22.0 | 15.7 | 71.4 | 67.0 | 53.8 | 80.3 |

*capsule wall according to Example 5
**capsule wall according to Example 6
Δ = percentage proportion of the absorption after exposure
b.e. = before exposure
a.e. = after exposure

EXAMPLE 14

A coated-front paper with a coating weight of about 5 g/m² is produced analogously to Example 8 using the developer according to Example 4.

EXAMPLES 15-19

The coated-front papers produced in Example 14 were tested analogously to Examples 9 to 13. The absorption values of the copies before and after exposure are shown in Table 2.

TABLE 2

Absorption values in % of the copies before/after exposure for 24 hours

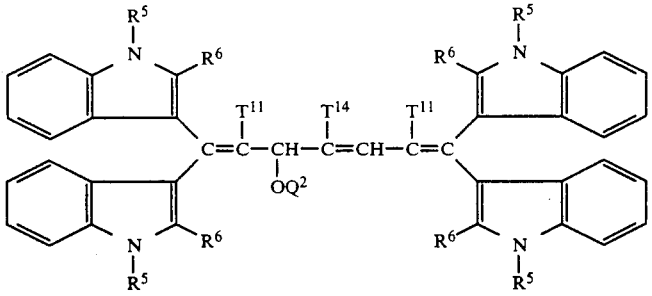

| Ex. | $R^5$ | $R^6$ | $Q^2$ | $T^{11}$ | $T^{14}$ | Salicylate resin coated-front (according to Ex. 4) b.e. | a.e. | Δ |
|---|---|---|---|---|---|---|---|---|
| 15* | $CH_3$ | Ph | $CH_3$ | H | H | 70.4 | 60.2 | 85.5 |
| 16* | $C_4H_9$ | Ph | $CH_3$ | H | H | 73.8 | 67.1 | 90.9 |
| 17* | $C_2H_5$ | Ph | $CH_3$ | H | H | 82.1 | 68.3 | 83.2 |
| 18** | $CH_3$ | Ph | $CH_3$ | H | 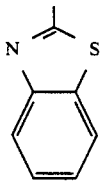 | 74.8 | 69.2 | 92.5 |

TABLE 2-continued

| | | | | | | | | |
|---|---|---|---|---|---|---|---|---|
| 19* | $CH_3$ | Ph | $CH_3$ | H | 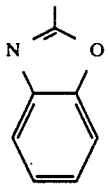 | 66.1 | 54.0 | 81.7 |

*capsule wall according to Example 5
**capsule wall according to Example 6
Δ = percentage proportion of the absorption after exposure
b.e. = before exposure
a.e. = after exposure

We claim:

1. Pressure-sensitive reactive recording material containing color-forming agents and color developers as characteristic constituents, characterized in that a) the dyestuff-forming agent is a tetraindolylheptamethine of the formula I/1, I/2, I/3 or I/4.

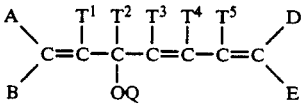

I/1

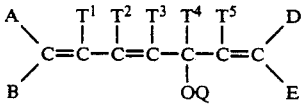

I/2

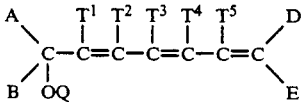

I/3

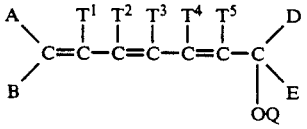

I/4 b) and the color developer is the salt of a polyvalent metal and an aromatic carboxylic acid having at least 10 carbon atoms, of the formula (II)

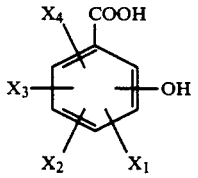

(II)

wherein, in the abovementioned formulae, A, B, D and E denote

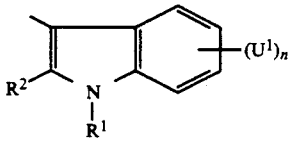

and can be identical to or different from one another,

Q denotes hydrogen, alkyl, alkenyl, cycloalkyl, aralkyl, aryl or a heterocyclic radical which is bonded via alkyl, $R^1$ denotes hydrogen, alkyl, alkenyl, cycloalkyl, aralkyl or a heterocyclic radical which is bonded via alkyl, $R^2$ denotes hydrogen, alkyl, alkenyl, cycloalkyl, aralkyl aryl or a heterocyclic radical, $T^1$ to $T^5$ denotte hydrogen, alkyl, alkenyl, cycloalkyl, aralkyl, halogen, alkoxy, dialkylamino, cyano, hydroxycarbonyl, alkoxycarbonyl, aryl or a heterocyclic radical, or in each case two of the radicals $T^1$ to $T^5$ denote the missing members of a 5- or 7-membered ring, which can be aromatic or partly hydrogenated and can contain up to 2 heteroatoms from the series comprising O, N or S, $U^1$ denotes hydrogen, alkyl, alkenyl, cycloalkyl, aralkyl, aryl, hydroxyl, alkoxy, halogen, dialkylamino, nitro, cyano, alkylthio, alkoxycarbonyl, dialkylaminocarbonyl, alkoxycarbonyloxy or alkylsulphonyl, or, together with $R^1$, denote a $C_2$-or $C_3$-bridge, denotes 1 or 2, $X_1$, $X_3$ and $X_4$ denote hydrogen, halogen, hydroxyl, alkyl, cycloalkyl, aryl, alkaryl, aralkyl, alkoxy or aryloxy, or two adjacent radicals $X_1$, $X_2$, $X_3$ and $X_4$ together can form a ring, and wherein all of the cyclic and non-cyclic radicals can carry nonionic substituents.

2. Pressure-sensitive recording material according to claim 1, characterized in that the color developers used are those of the formula II wherein at least one of the radicals $X_1$–$X_4$ represents aralkyl and the other radicals represent H.

3. Pressure-sensitive recording material according to claim 1, characterized in that the color developers used are those of the formula VIII:

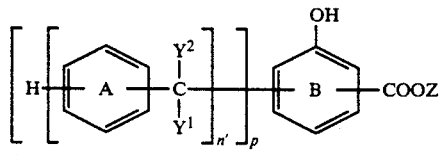

VIII wherein the rings A and B can contain further substituents and wherein $Y^2$ denotes H or $CHY^3Y^4$ and $Y^1$, $Y^3$ and $Y^4$ independently of one another denote H or alkyl or, together with at least 2 C atoms of the ring A, denote the radical to complete a ring, denotes $M^+/m$ M denotes an m-valent metal ion, m denotes an integer, n' denotes an integer, at least 1, and p denotes an integer from 1to 4.

4. Pressure-sensitive reactive recording material according to claim 3, wherein $Y^1$, $Y^3$ and $Y^4$ independently denote an alkyl of from 1to 4C atoms.

5. Pressure-sensitive reactive recording material according to claim 3, wherein $n^{40}$ denotes an integer of from 2 to 30.

6. Pressure-sensitive reactive recording material according to claim 3, wherein n'denotes an integer of from 3 to 6.

7. Pressure-sensitive reactive recording material according to claim 3, wherein M denotes $Cu^{2+}$, $Zn^{2+}$, $Fe^{2+}$, $Fe^{3+}$, $Al^{3+}$, $A1^{3+}$, $Mg^2$ or $Ca^{2+}$.

8. Pressure-sensitive reactive recording material according to claim 3, wherein m denotes the integer 2 or 3.

9. Pressure-sensitive recording material according to claim 1, characterized in that the color developers used are those of the formula IX

IX

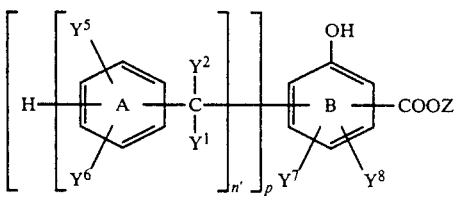

wherein $Y^1$ to $Y^4$, Z, M, m, n' and p have the abovementioned meaning, and wherein, $Y^5$ to $Y^8$ independently of one another denote hydrogen, alkyl, aralkyl, halogen, alkoxy, COOH, $COOY^9$, CN, $NO_2$ or —O—CO—$Y^{12}$ or cycloalkyl, wherein $Y^7$ and $Y^8$ independently of one another can also denote

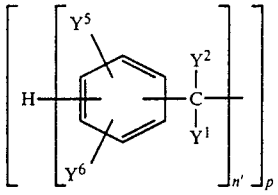

wherein $Y^9$ denotes alkyl, aryl, or $NY^{11}Y^{10}$, $Y^{10}$ and $Y^{11}$ independently of one another denote hydrogen or alkyl, and $Y^{12}$ denotes alkyl.

10. Pressure-sensitive reactive recording material according to claim 9, wherein $Y^5$ to $Y^8$ independently denote an alkyl having 1 to 18 C atoms.

11. Pressure-sensitive reactive recording material according to claim 9, wherein $Y^5$ to $Y^8$ independently denote an benzylor a-methylbenzyl.

12. Pressure-sensitive reactive recording material according to claim 9, wherein $Y^5$ to $Y^8$ independently denote chlorine.

13. Pressure-sensitive reactive recording material according to claim 9, wherein $Y^5$ to $Y^8$ independently denote an alkoxy having 1 to 24 C atoms.

14. Pressure-sensitive reactive recording material according to claim 9, wherein $Y^9$ denotes an alkyl having 1 to 24 C atoms.

15. Pressure-sensitive reactive recording material according to claim 9, wherein $Y^9$ denotes phenyl.

16. Pressure-sensitive reactive recording material according to claim 9, wherein $Y^{10}$ and $Y^{11}$ independently denote an alkyl having 1to 24 C atoms.

17. Pressure-sensitive reactive recording material according to claim 9, wherein $Y^{12}$ denotes an alkyl having 1 to 18 C atoms.

18. Pressure-sensitive reactive recording material according to claim 9, wherein the group COOZ in ring B is preferably in the o-position relative to the OH group.

19. Pressure-sensitive reactive recording material according to claim 1, wherein $R^2$ denotes a heterocyclic radical which is bonded via alkyl.

20. Pressure-sensitive reactive recording material according to claim 1, wherein T1 to T5 independently denote a heterocyclic radical which is bonded via alkyl.

* * * * *

UNITED STATES PATENT AND TRADEMARK OFFICE

CERTIFICATE OF CORRECTION

PATENT NO. : 5,024,987

DATED : June 18, 1991

INVENTOR(S) : Klug et al.

It is certified that error appears in the above-identified patent and that said Letters Patent is hereby corrected as shown below:

| | |
|---|---|
| Col. 8, line 18 | Delete " M+/M " and substitute -- $M^+/m$ -- |
| Col. 8, line 22 | Delete " $n^1$ " and substitute -- n' -- |
| Col. 8, line 39 | Delete " $n^1$ " and substitute -- n' -- |
| Col. 9, line 15 | After " but " insert -- - -- |
| Col. 10, line 20 | After " ABS " delete " $_{80}$ " and substitute --$\lambda$--, after " wavelength " delete " $_{80}$ " and substitute --$\lambda$-- |
| Col. 10, line 22 | After " wavelength " delete " $_{80}$ " and substitute --$\lambda$-- |
| Col. 10, line 23 | After " Ref. copy " delete " $_{80}$ " and substitute --$\lambda$-- |

UNITED STATES PATENT AND TRADEMARK OFFICE

CERTIFICATE OF CORRECTION

PATENT NO. : 5,024,987

DATED : June 18, 1991

INVENTOR(S) : Gunter Klug, et al

It is certified that error appears in the above-identified patent and that said Letters Patent is hereby corrected as shown below:

| | |
|---|---|
| Col. 10, line 24 | After " length " delete "$_{80}$ " and substitute --$\lambda$-- |
| Col. 14, line 43 | After " Abs " delete " $_{80}$ " and substitute --$\lambda$-- |
| Col. 18, line 20 | Delete " denotte " and substitute -- denote -- |
| Col. 18, line 35 | Before " denotes " insert -- n -- |
| Col. 18, line 36 | After " $X_1$, " insert -- $X_2$-- |
| Col. 18, line 64 | Before " denotes " insert -- Z -- |
| Col. 19, claim 5 line 2 | After " n " delete " $n^{40}$ " and substitute -- n' -- |

Signed and Sealed this

Thirtieth Day of March, 1993

*Attest:*

STEPHEN G. KUNIN

*Attesting Officer*

*Acting Commissioner of Patents and Trademarks*